United States Patent [19]

Engels et al.

[11] 4,085,700

[45] Apr. 25, 1978

[54] APPARATUS FOR SCULPTURING PILE FABRICS

[75] Inventors: Walter Engels, Tryon, N.C.; Charles E. Willbanks, Spartanburg, S.C.

[73] Assignee: Milliken Research Corporation, Spartanburg, S.C.

[21] Appl. No.: 750,888

[22] Filed: Dec. 15, 1976

[51] Int. Cl.[2] ..... D06C 23/02

[52] U.S. Cl. ..... 118/37; 26/15 R; 26/16; 26/105

[58] Field of Search ..... 26/15 R, 15 L, 15 FB, 26/16, 69 B, 105; 118/37

[56] References Cited

U.S. PATENT DOCUMENTS

| | | | |
|---|---|---|---|
| 324,428 | 8/1885 | Sumner | 26/16 |
| 1,294,516 | 2/1919 | Moore | 26/16 |
| 1,593,046 | 7/1926 | Suits | 26/16 |
| 2,594,846 | 4/1952 | Bechter | 26/105 X |
| 3,769,666 | 11/1973 | Kaufman | 26/15 R |

FOREIGN PATENT DOCUMENTS

| | | | |
|---|---|---|---|
| 211,309 | 6/1909 | Germany | 26/15 R |
| 82,966 | 4/1920 | Switzerland | 26/105 |
| 218,659 | 11/1924 | United Kingdom | 26/105 |

*Primary Examiner*—Robert R. Mackey
*Attorney, Agent, or Firm*—Robert S. Alexander; H. William Petry

[57] ABSTRACT

A device for sculpturing pile fabrics which have been treated by stiffening the fibers thereof in selected regions. The device includes means for advancing the fabric, a support and a blade which severs the stiffened fibers as they pass over the support but allows the unstiffened fibers to deflect away from the blade.

11 Claims, 13 Drawing Figures

APPARATUS FOR SCULPTURING PILE FABRICS

This invention relates to sculpturing the pile of pile fabrics. More particularly this invention relates to apparatus for removing the pile from selected regions of a pile fabric to form either a pre-determined or a random pattern.

Methods and apparatus for removing the pile from selected regions of pile fabrics are well known; however, many of the prior art methods and apparatus have serious disadvantages in that size or adhesive is applied to the regions from which the pile is not to be removed and then the pile is crushed or compressed in those regions. This requires large amounts of size or adhesive and the crushing results in degradation of the fibers in those regions where the pile is to remain intact.

U.S. Pat. No. 605,710 discloses a method in which size is applied to all of the fibers of a pile fabric. The fibers in the regions from which the fibers are not to be removed are then crushed below the level of the fibers in the regions from which the pile is to be removed. The pile is then sheared from the region which has not been crushed. The size is then removed from the fabric.

U.S. Pat. No. 3,422,512 discloses a similar method wherein adhesive is applied only to the regions from which the pile is not to be removed.

It is an object of the invention to provide apparatus for removing the pile from selected regions of pile fabric without degrading the fibers in other regions.

It has been discovered that it is possible to achieve these objects by applying a stiffening agent to those regions from which it is desired to remove the pile. The stiffening agent is then hardened and the fabric is drawn past a blade which allows the fibers in the untreated regions to deflect out of the way while severing the fibers in the regions to which the stiffening agent has been applied. The residual stiffening agent is then removed by scouring, washing or other convenient methods.

This method does not result in degradation of the fibers in the untreated regions, does not require mechanical means to compress the pile of the fabric and is economical of stiffening agent.

Figure 1:
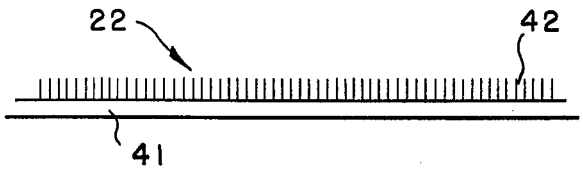
FIG. 1 is a schematic cross-section of the untreated pile fabric.
Figure 3:
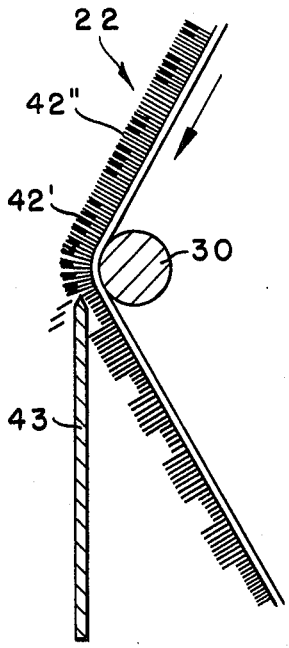
FIG. 3 illustrates the sculpturing of a pile fabric wherein selected fibers have been stiffened by application of stiffening agent.
Figure 2:
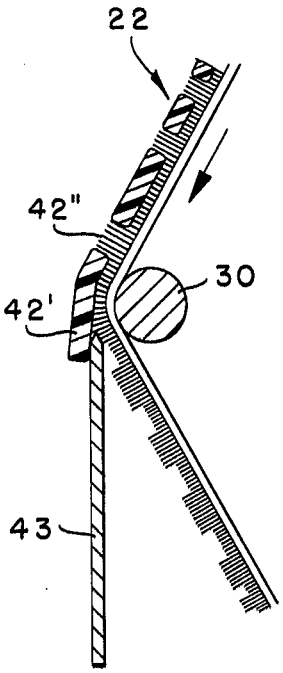
FIG. 2 illustrates sculpturing of a pile fabric by passing it over a roller adjacent to a blade. Only the pile fibers which are embedded in solid stiffening agent are severed.
Figure 4:
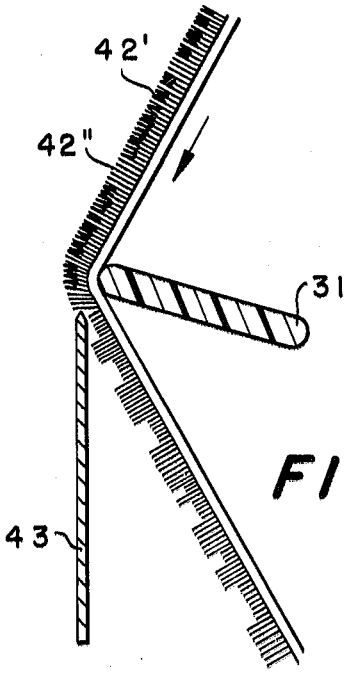
FIG. 4 illustrates the sculpturing of a pile fabric as it passes over a nose bar.

Referring now to the drawings, pile fabric 22 is shown in FIG. 1. Fabric 22 comprises backing 41 and pile 42. In FIG. 2, fabric 22 is shown passing over roller 30 adjacent to blade 43. Stiffening agent has been applied to selected regions of the pile 42' and hardened to form solid layers in which the fibers of the pile become embedded. As fabric 22 is drawn over roller 30 past blade 43, the fibers in the untreated regions 42" are free to deflect away from blade 30 and are not severed while the embedded fibers in regions 42' are restrained by the stiffening agent and are severed by the blade. In FIG. 3, the amount of stiffening agent that has been applied to the fabric is smaller than the amount that was applied in FIG. 2. In this case, the fibers in the treated regions 42' are stiffened and joined together into small clusters of fibers. As these clusters pass over roller 30, they are not free to deflect away from blade 43 and are severed. As before, the fibers in untreated regions 42" are not severed. In FIG. 4, roller 30 has been replaced by nose bar 31.

The apparatus of the present invention may be used on any suitable pile fabrics such as velvets, velours or even carpets. The apparatus may be used whatever the method of fabric construction, whether it be tufted, woven, knit or bonded. A material which is particularly well suited to the present invention is a velvet of cut pile and tufted construction. The pile or face fiber is of 13/1 acrylic yarn. There are 25 tufts in the weft direction and 40 tufts in the warp direction. Pile height is 3/32 inch. The substrate is woven polyester of a drill construction having 38 picks per inch and 68 ends per inch. The tufts are held in with a latex backcoating. Final weight of the fabric is 1.1 lb/yd$^2$. In order to insure maximum flexibility of the pile fibers, the fabric may be heated by steaming, scouring in hot water or other similar methods before printing.

The fabric may be dyed either before or after sculpturing. If it is to be dyed afterwards, then special care must be taken to remove all residual stiffening agent to avoid imperfections.

For the purposes of the present invention, suitable stiffening agents include any materials which upon hardening tend to have a tendency to stiffen the fibers in the pile or to bond them together or to harden into a film in which the fibers become imbedded. Such stiffening agents can include sizing materials, adhesives, admixtures of water and thickening agents, and hot melt adhesive. When an admixture of water and thickening agent is used, hardening can be accomplished by freezing the water. When a hot melt adhesive is used, hardening is accomplished by allowing the adhesive to cool. The preferred stiffening agents are liquid admixtures of water and polyvinyl acetate, polyvinyl alcohol, acrylic monomers, sulfonated polyester type size materials, or methyl cellulose, although many other solvents and adhesives may be used. Typical admixtures will contain from about 9 to 100% solids. The preferred solids content is around 50% solids. The preferred stiffening agents have a viscosity with a range of 800 to 40,000 cp depending upon the method chosen for application. The most preferred stiffening agents are alkali soluble emulsions of the polymers of acrylic monomers in water having solids contents of approximately 50%. Advantageously, the solids of the stiffening agents will be formed from 25–50% ethyl acrylate, 25–50% methyl acrylate, 20–40% methyl methacrylate and 5–15% acrylic or methacrylic acid, the total being 100%. Butyl acrylate, 2-ethyl, hexyl acrylate, and various acrylic esters may also be used. These most preferred stiffening agents have sufficient flexibility to insure that the film resulting after curing will pass over the rollers of the equipment without cracking or breaking. If it is desired to apply the stiffening agents by rotary screen printing, it is advantageous to include an anti-drying agent and to adjust the viscosity to around 30,000 cp. Suitable anti-drying agents would include any non-volatile polyglycol having hygroscopic properties such as ethylene glycol, propylene glycol or glycerine. Many other anti-drying agents will be obvious to those skilled in the art. The viscosity can be adjusted by varying the pH. A liquid admixture of water and thickening agent can also be used as a stiffening agent. In that case, hardening can be accomplished by freezing the water. After sculpturing, residual stiffening agent can then be removed by melting the water. Both natural and synthetic thickening agents can be used. The sodium or ammonium salts of polyacrylic acids are examples of suitable synthetic thickeners. Natural thickeners include but are not limited to gums and alginates. Suitable gums include Gum Arabic, Karaya Gum, Tragacanth and the gum obtained from locust beans.

Different hot melt adhesives are suitable for different fabrics. Preferably the adhesive will be a material which melts below the melting point of the pile fibers but is a solid at ambient temperature.

The amount of stiffening agent required will depend upon the nature of the fibers in the pile and upon the sizing material. Enough stiffening agent should be applied to cause the fibers in the treated regions to be unable to deflect out of the path of the blade. The amount of stiffening agent which is generally effective is from about 25 to 200% of the weight of the pile in the area which is to be treated. In determining the amount of stiffening agent to be used, the weight of the pile in those areas which are not to be trimmed is immaterial. It has been found that the higher percentages in this range are preferred and that in the most preferred mode enough stiffening agent is applied to form a continuous layer in which the tops of the fibers of the pile become immersed. If the stiffening agent is applied to form a continuous layer, it is often advantageous to include a blowing agent to give the fibers in the pile an upright posture upon hardening. Suitable blowing agents include any substances which can be caused to expand greatly or evolve gas when the stiffening agent is hardened.

The stiffening agent may be applied by any method which confines the application to those regions in which the pile is to be trimmed. Advantageously, the fibers in the pile may be given an upright posutre before the sizing material is applied. Suitable methods include rotary screen printing, silk screen printing, roller printing, gravure printing, jet printing and many others, as will be apparent to those skilled in the art. Advantageously, the fibers of the pile will be maintained in an upright posutre while the fabric is being cured.

After application of the stiffening agent, it is hardened. Hardening includes any step which causes the sizing material to solidify, or causes the fibers to bond together or to become stiff. If relatively small amounts of stiffening agent have been applied, the effect of hardening is primarily to stiffen each individual fiber by solidifying the coating of sizing material on each individual fiber. Hardening will also serve to bind the fibers together into small clusters. If larger amounts of stiffening agent have been used, the effect of hardening is to imbed the fibers into a film of solid stiffening agent. In either case, the ability of the treated fibers to deflect out of the path of a blade is decreased while those fibers in the untreated regions remain free to deflect out of the path of the blade. For solvent carried stiffening agent, curing can include any step which results in the removal of the solvent or carrier. If an appropriate solvent which evaporates very quickly is used, it could even include self-hardening by exposure to ambient conditions. As stated previously, if an admixture of water and thickening agent is used as a stiffening agent, hardening can be accomplished by freezing the water and if hot melt adhesives are used, then hardening is accomplished by allowing the adhesives to cool.

For the preferred stiffening agents of this invention, hardening is principally effected by the removal of the solvent, usually water, from the stiffening agent. Placing the fabric in an oven at about 300° F for 5 minutes is usually sufficient. An air impingement heater can also be used. It has been found that if the heater discharges 370° F air at a velocity of 8,000 feet per minute, then hardening can be accomplished in approximately 2 minutes. It has also been found that heat from infra-red lamps may be used to effect curing. If infra-red lamps are used alone for the hardening of the adhesive, and if the speed of the fabric is 3 yards per minute, then 6 to 8 banks of quartz face heaters 10 inches by 80 inches disposed transverse to the fabric and 9 inches from the face of the fabric are usually sufficient, if the faces of the heaters are maintained at 800° F. For each combination of stiffening agent and fabric, individual hardening conditions will need to be determined to avoid scorching of the fabric. Those skilled in the art are familiar with methods to effect maximum drying while not scorching the fabric. Such adjustments are not difficult since they can be made as the heater operates based on the appearance of the fabric as it leaves the heater. It has been found to be especially advantageous to expose the fabric sequentially to infra-red heat and then to an air impingement heater. If the fabric speed is 3 yards per minute, this is best accomplished by passing the fabric first under 4 banks of infra-red heaters at 800° F as above. The fabric is then exposed to the output of an air impingement dryer discharging air at about 165° F at a velocity of about 8,000 feet per minute for about 1 minute.

Figure 8:
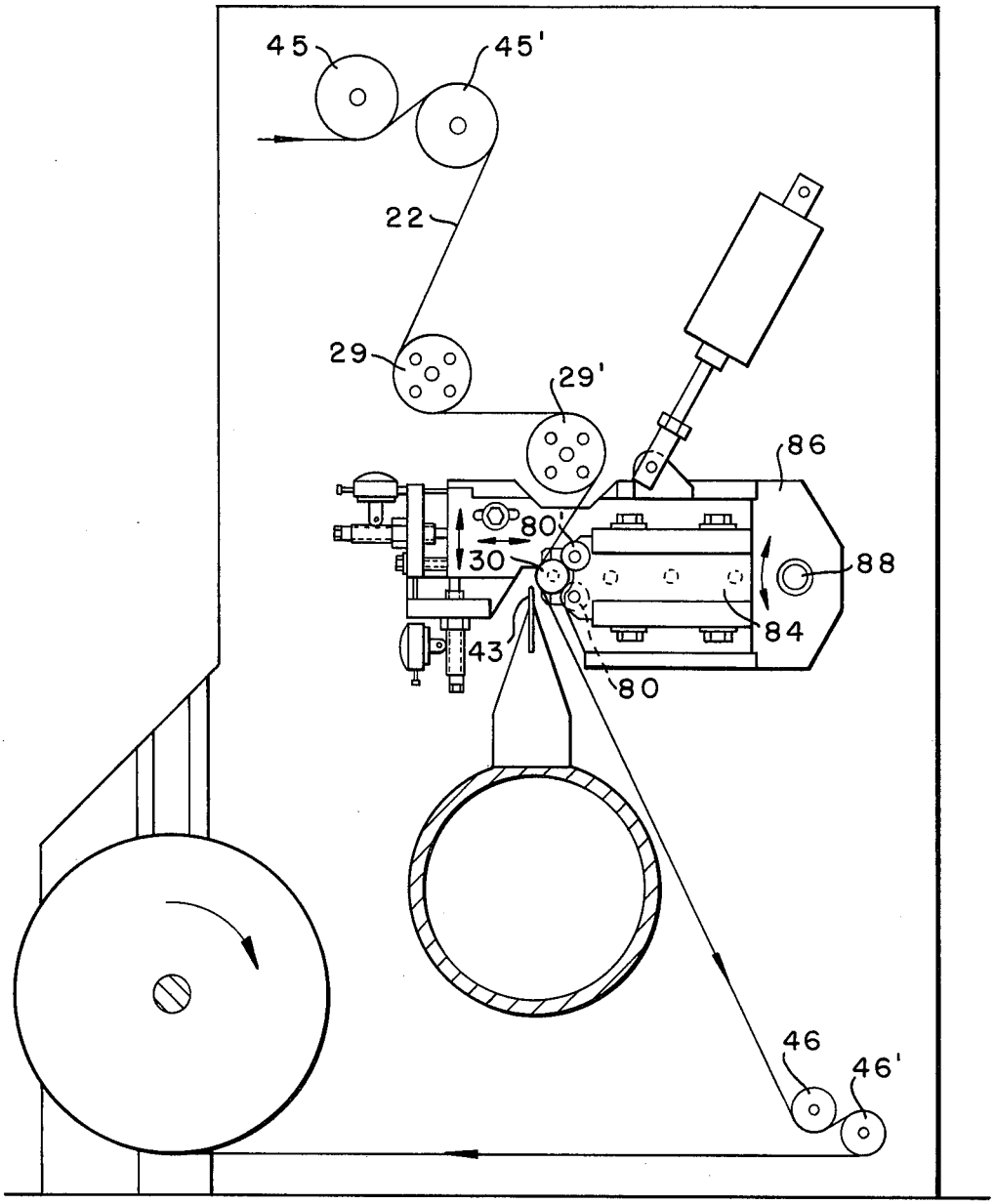
FIG. 8 is a sectional view taken along line 8—8 in FIG. 6.
Figure 9:
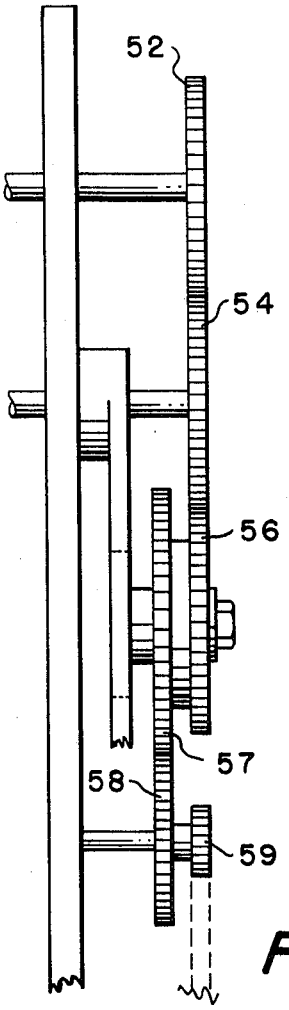
FIG. 9 is a sectional view taken along line 9—9 in FIG. 7.

After the stiffening agent has been hardened, the fibers in the treated regions may be trimmed by passing the fabric by a blade which allows the fibers in the untreated regions to deflect but severs the fibers in the treated regions. Alternatively, the blade may be drawn past the fabric. Advantageously, the fabric may be drawn over a roller or nose bar which is adjacent to a cutter. In the most preferred mode, the fabric is drawn over a roller. In FIG. 8, fabric 22 is being drawn over roller 30 adjacent to blade 43, the motion of which blade is parallel to the surface of support roller 30. As the fibers in the untreated regions pass over roller 30, they are free to deflect away from blade 43 and are not severed. The fibers in the treated regions are severed by blade 43 as they pass over the roller 30. It has been found that if the included angle of the blade is about 60° and if the speed of the fabric is from about 3 to 20 feet per minute and if the speed of the blade is less than about 300 feet per miniute, then the fibers in the untreated regions will not be severed, but the fibers in the treated regions will be severed. For each fabric speed, there appears to be an optimum blade speed. If the fabric speed ia 5 feet per minute, it has been found that the best results are obtained when the speed of the blade is approximately 50–100 feet per minute. The optimum location of the edge of the blade with respect to the nose bar or roller varies with the type of fabric being treated. The optimum location is determined by adjusting the cutter while it is running. It is then possible to determine visually when satisfactory sculpturing is taking place.

After sculpturing, the fabric may be scoured to remove residual stiffening agent, if any. If the stiffening agent contains acrylic monomers, it is advantageous for the scouring solution to be slightly alkaline.

Figure 5:
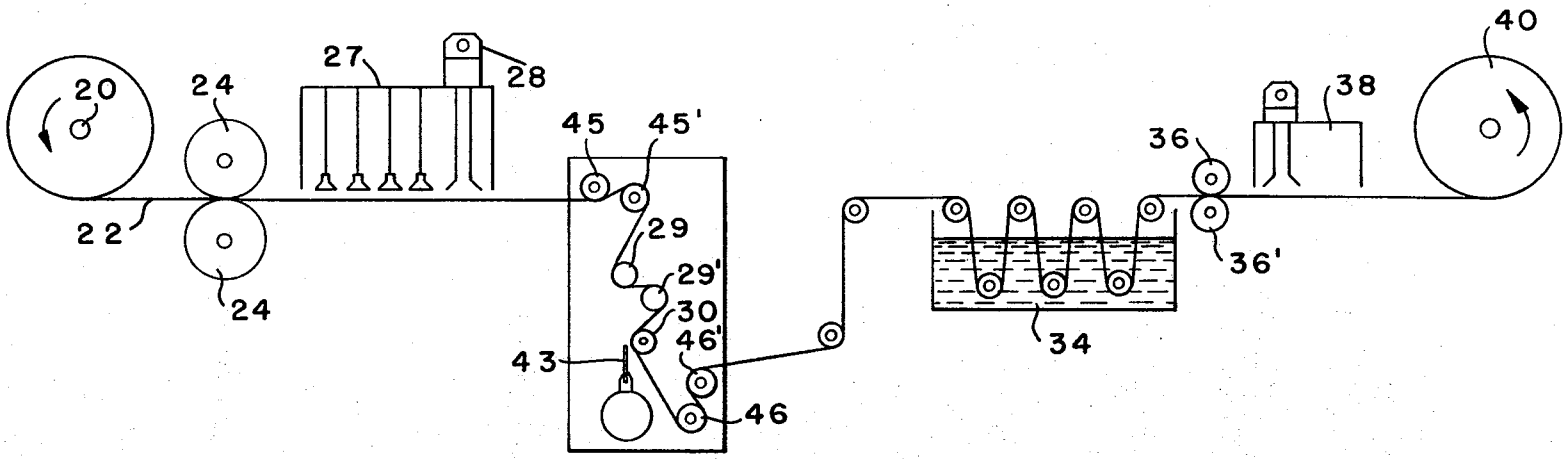
FIG. 5 is a schematic flow diagram of a process for automatically sculpturing fabric in accordance with the present invention.
Figure 6:
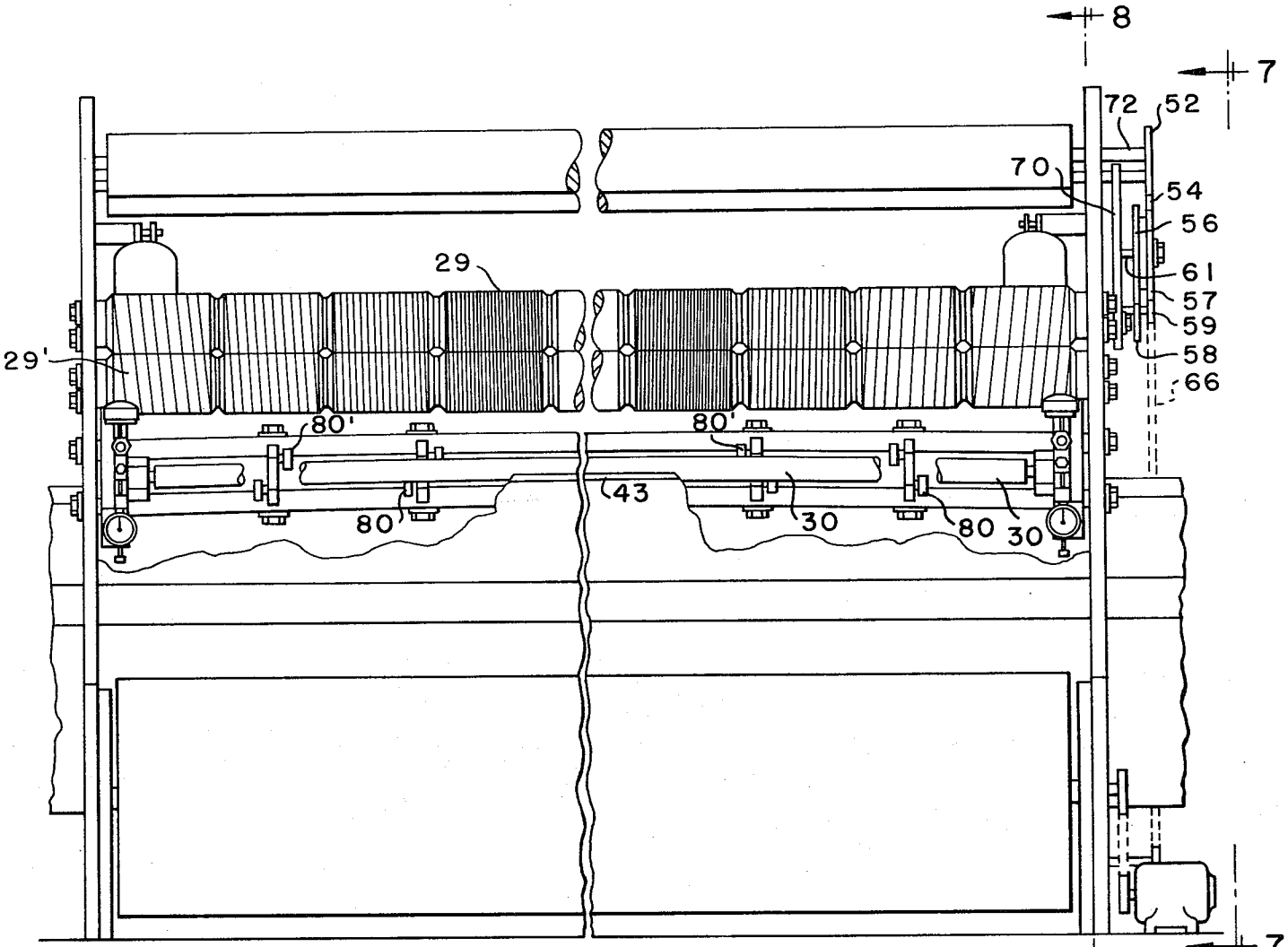
FIG. 6 is a front elevation of a cutter for sculpturing of pile fabrics.

The present invention can be carried out in a continuous operation on the apparatus shown in FIG. 5. FIG. 5 shows a storage roller 20, rotary screen printer 24, hardening chamber 27, spreader bars 29, 29', support roller 30, scouring bath 34, squeeze rollers 36, 36', drying oven 38, storage roll 40 and a motor for driving the fabric. In operation, fabric 22, which is either dyed or undyed is stored on roller 20. Fabric 22 is brought into contact with the screen of a rotary screen printer 24. The screen is closed in those regions corresponding to the regions of the fabric where it is desired to maintain the length of the fibers in the pile. The stiffening agent passes through the open portions of the screen and onto the fabric in the regions from which it is desired to remove the pile. After the fabric passes through hardening chamber 27, where it is heated by infra-red lamps 26 and by air impringement heater 28, it passes over spreader bars 29, 29', then over roller 30 past blade 43 where the fibers in the treated regions are removed. The fabric then passes through scouring bath 34, a pair of squeeze rollers 36, 36', drying oven 38, and is taken up on storage roll 40.

Figure 7:
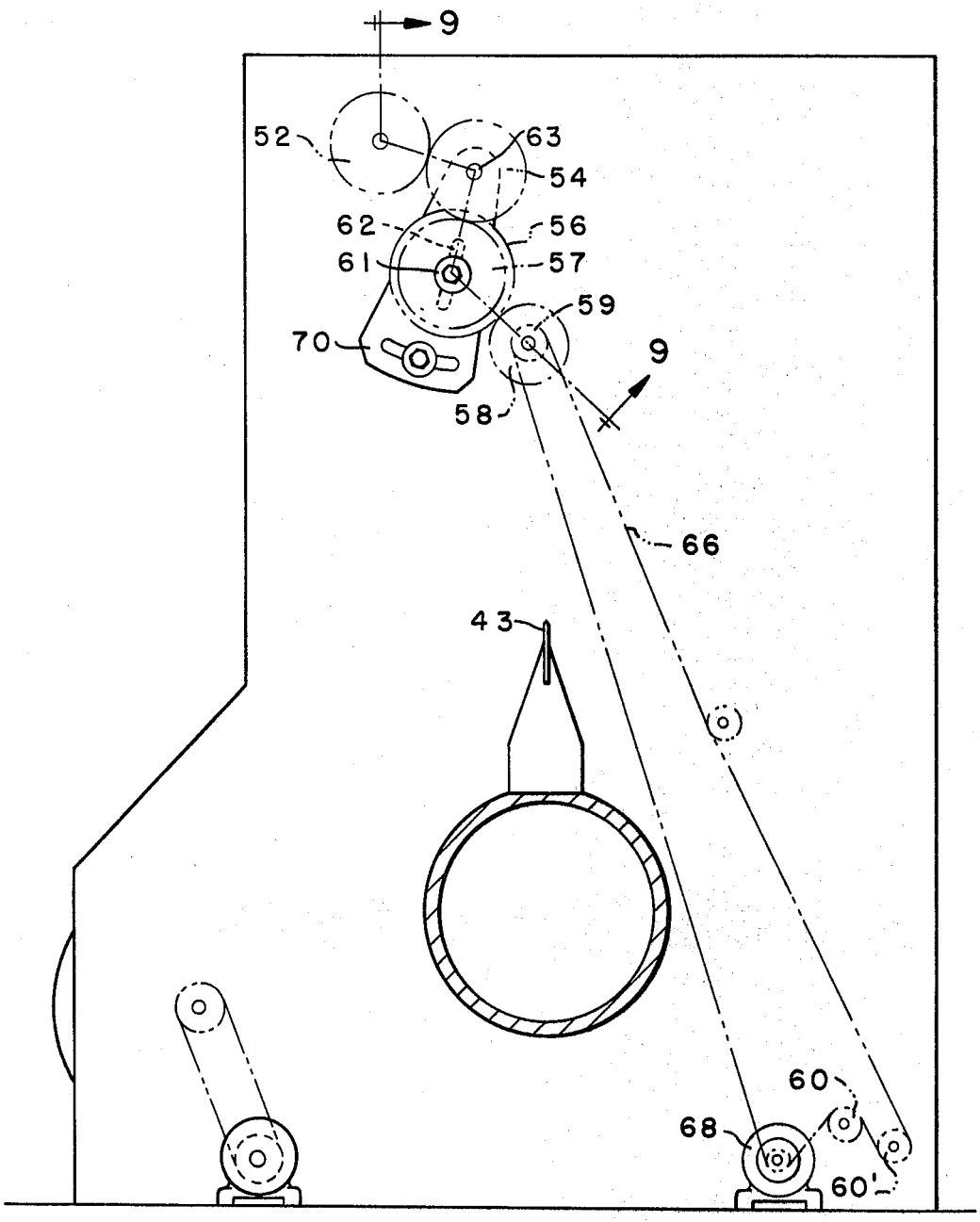
FIG. 7 is a sectional view taken along line 7—7 in FIG. 6.

The shearing step of the present invention may be carried out on any cutter which allows the untreated fibers to remain unsevered but severs the treated fibers. It is necessary only that the cutter operate in the same manner as a knife or razor as opposed to cutting like a pair of scissors. Such a cutter is shown in FIGS. 6, 7, 8, 12 and 13. When the fabric passes over the roller adjacent to the knife blade, it desirably will be uniformly tensioned and free from wrinkles. Conventionally, uniform tension is maintained by underfeeding the fabric and driving the take-up through a slip clutch. It has been found that more satisfactory results are obtained if the fabric is underfed by such an amount that the desired tension is produced by elongation of the fabric. In FIGS. 7 and 8, motor 68 drives chain 66 which in turn drives sprocket 59 fastened to gear 58 and gears 60 and 60'. Gear 58 drives gears 57, 56, 54, and 52. Gear 52 drives supply roller 45 and gear 54 drives supply roller 45'. Gears 60 and 60' drive take-up rollers 46 and 46'. By suitably choosing gears 56, 57 and 58, one can cause take-up rollers 46 and 46' to take up the fabric faster than it is supplied over supply rollers 45 and 45'. While it is not always possible to obtain the exact amount of underfeed desired using this arrangement, it is generally possible to obtain a rate of underfeed which is within a fraction of a percent of the desired amount of underfeed. Gears 56 and 57 are fixed to each other and are mounted on shaft 61 which is adjustably positionable in slot 62 on arm 70. Arm 70 pivots on shaft 63 upon which gear 54 is also mounted. When gears 56, 57 and 58 are changed, the location of shaft 61 can be changed so that gears 57 and 54 engage each other. Arm 70 is then rotated about shaft 63 to bring gears 56 and 58 into engagement. In this manner a wide variety of gears can be accommodated to yield the desired underfeed.

Figure 13:
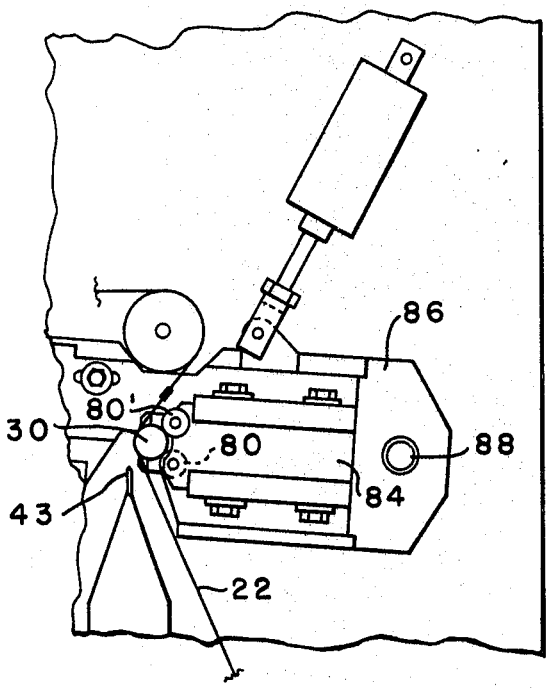
FIG. 13 is an enlarged view of the roller support.
Figure 12:
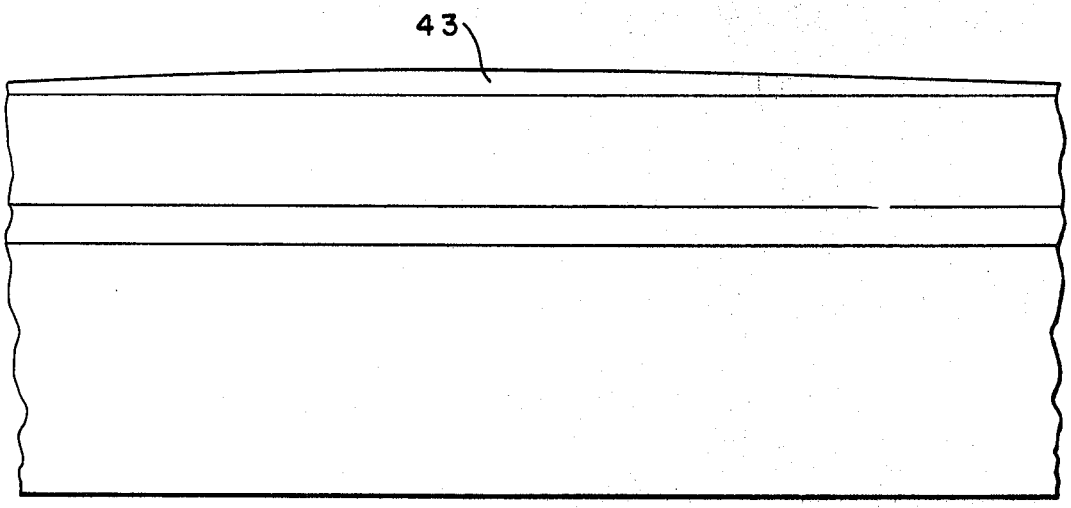
FIG. 12 is an enlarged front view of the blade in FIG. 6, showing the curvature of the blade in more detail.
Figure 10:
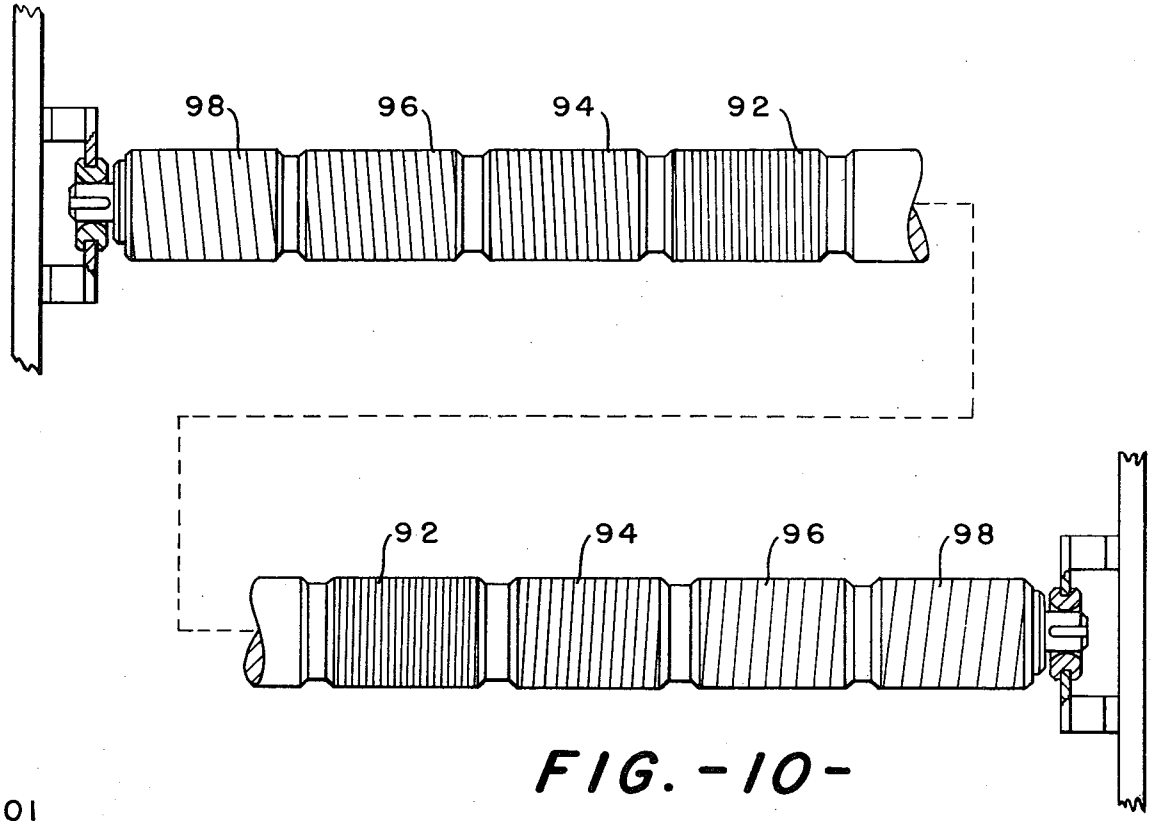
FIG. 10 is a front elevation of a spreader bar.
Figure 11:
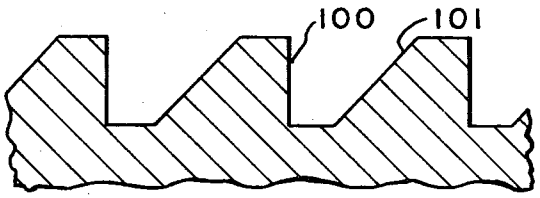
FIG. 11 is an enlarged cross-sectional view showing the threads on a spreader bar.

Just prior to sculpturing, fabric 22 passes over a pair of spreader bars 29, 29' which insure that the fabric will be unwrinkled when it passes over the support roller 30. The spreader bar 29 is shown in more detail in FIGS. 10 and 11. The bar 29 is a generally cylindrical member having a plurality of threaded portions 92, 94, 96, 98 . . . The helix angle of each of the threaded portions is such that the fabric is stretched from the center as fabric 22 passes over spreader bar 29. The helix angle of each threaded portion 92, 94, 96, 98 . . . away from the center of the spreader bar is greater than the helix angle of any threaded portion 92, 94, 96, 98 . . . which is nearer to the center of the spreader bar. As shown in FIG. 12, each thread is formed with a vertical wall 100 on the side farthest from the center of the bar and an inclined wall 101 on the side closest to the center of the bar. After the fabric passes over spreader bars 29, 29', it passes over support roller 30 adjacent to blade 43. Advantageously, the position of support roller 30 is adjustable with respect to the blade. FIG. 13 shows support roller 30 mounted on extension arm 84 which is fixed to pivotable lever arm 86. By pivoting lever arm 86 about pivot pin 88, support roller 30 can be moved into close proximity with blade 43 and can be withdrawn. Advantageously, extension arm 84 is slidably affixed to lever arm 86 and can be adjusted radially to position support roller 30 at the proper location. If desired, the position of blade 43 can also be adjusted with respect to support roller 30.

Blade 43 can be any suitable member which severs the fibers in the treated regions but allows the fibers in the untreated regions to deflect away from the blade. Preferably, blade 43 is the blade of a rotating band saw. In that case, blade 43 would be moving parallel to the surface of support roller 30. By this means, it is possible to include self-sharpening means (not shown) at a location where the blade is not in contact with the fibers. However, most commercial band saws have blades which are slightly bowed as shown in FIG. 13. Preferably the distance between support roller 30 and blade 43 is uniform along the entire length of the roller. In the preferred embodiment, support roller 30 is supported by a plurality of pairs of adjustable bearing rollers 80 and 80' whereby the curvature of the support roller may be matched to the contour of blade 43.

The following examples will further illustrate this invention. It is to be understood that these are examples only and are not to be construed as limitations on the invention.

EXAMPLE I

Stiffening agent was prepared by adding ethylene glycol, anhydrous ammonia and fugitive tint to an aqueous emulsion formed from acrylic monomers. The particular aqueous emulsion used was GLO-REX 816 HV which is available from Glo-Tex Chemicals in Roebuck, S.C. This emulsion has an approximate solids content of 50%. The solids are polymers formed from between 25 and 50% ethyl acrylate, between 25 and 50% methyl acrylate, between 20 and 40% methyl methacrylate, and between 5 and 15% acrylic acid, the total being 100%. To this, 10% by weight of ethylene glycol was added. 1.5 grams of 28% anhydrous ammonia and 6 grams of a fugitive tint were added to each pound of the emulsion. The result was an emulsion having a viscosity of 18,000 cp. This emulsion was printed in a pattern onto a velvet fabric using a rotary screen printing machine. The screen mesh number was 30, and the printing speed was 3 yd/min.

The velvet fabric was of cut pile and tufted construction. The pile or face fiber was 13/1 acrylic yarn. There were 25 tufts in the weft direction and 40 tufts in the warp direction. Pile height was 3/32 inch. The substrate was woven polyester of a drill construction having 38 picks per inch and 68 ends per inch. The tufts were held in with a latex backcoating. Final weight of the fabric was 1.1 lb/yd$^2$. In order to insure maximum flexibility of the pile fibers, the fabric was scoured in hot water before printing.

The particular pattern used in printing had lines about 1/16 inch wide with a total open area of approximately 5%. The weight of stiffening agent applied to the fabric was approximately equal to fifty percent of the weight of the fabric affected.

The stiffening agent was pre-hardened by exposing the fabric to a bank of infra-red heaters set at a temperature of 900° F and located about 9 inches from the fabric. Final hardening was accomplished by exposing the fabric to air at 75° C in an impingement dryer for about 1½ minutes.

After hardening, the fabric was processed through a bandknife where the fibers in the printed areas were severed and the fibers in the non-printed areas remained unaffected. The bandknife is basically the same as the more familiar band saw except that the blade does not have teeth. The pile fibers were brought into contact with the knife blade by drawing the fabric over a nose bar suitably located relative to the cutting edge. The nose bar had a radius of approximately ⅛ inch. The blade moved parallel to the nose bar in the vertical plane with the cutting edge at the top. The fabric moved down against the cutting edge, entering the cutting zone at an angle of 60° relative to the vertical and leaving at an angle of 30° relative to the vertical. The position of the cutting edge was adjusted with the machine running to achieve optimum cutting and no exact measure of the geometry was made. However, the cutting edge was located in a zone represented by an ⅛ inch radius circle centered at the tip end of the nose bar. The blade speed was approximately 100 ft/min while the fabric speed was 10 ft/min. The included angle of the cutting edge was 60° and was symmetric with respect to a vertical line through the center of the blade.

A sculptured effect was achieved as the fiber in the printed areas was removed and the fiber in the non-printed areas left unaffected.

EXAMPLE II

The procedure followed was the same as Example I except that the stiffening agent was formed as follows: 18 parts by weight of solid poly (vinyl alcohol) were mixed with 82 parts boiling water in a high shear mixer. One part of a fugitive tint was added. This resulted in an emulsion having a viscosity of approximately 6,000 cp.

We claim:

1. Apparatus for producing a pile fabric having selected regions in which the pile has been trimmed, comprising:

(a) means for stiffening selected regions of a pile fabric whereby a pile fabric having regions of stiffened and unstiffened fibers is formed;

(b) cutter means for trimming the pile from the stiffened regions, said cutter means including:

(i) blade means for contacting both the stiffened fibers in the pile fabric and the unstiffened fibers while severing the stiffened fibers and deflecting the unstiffened fibers without severing them, said blade means cutting in the same fashion as a knife or razor as opposed to cutting like a pair of scissors;

(ii) support means closely adjacent to said blade means for maintaining said pile fabric in contact with said blade means; and (iii) means for effecting relative motion between said blade means and said pile fabric, and (c) means for supplying said pile fabric having regions of stiffened and unstiffened fibers to said cutter means.

2. The apparatus of claim 1, wherein said support means is a roller and further comprising means for tensioning said fabric as it passes over said roller.

3. The device of claim 2 wherein said blade is an endless translating flexible band.

4. The apparatus of claim 2 wherein said means for stiffening the fibers in selected regions of the pile fabric comprises means for applying a continuous layer of stiffening agent and imbedding the tops of said fibers in said layer of stiffening agent, and hardening said stiffening agent.

5. The device of claim 4 wherein said blade is a translating endless flexible band.

6. The device of claim 5 further comprising means for adjusting the relative positions of said roller and said blade with respect to each other.

7. The device of claim 5 further comprising means for matching the curvature of said roller to the curvature of said endless flexible band.

8. The device of claim 7 wherein the means for adjusting the curvature of said roller includes a plurality of adjustable bearing rollers.

9. The device of claim 8 further comprising means for maintaining the fabric in an unwrinkled state.

10. The device of claim 9 wherein the means for maintaining the fabric is an unwrinkled state comprises:

a spreader bar having a plurality of sets of threads, each set of threads from the center of the bar towards the ends of the bar having a helix angle greater than the helix angle of the sets of threads closer to the center of the bar.

11. The apparatus of claim 1 wherein said means for stiffening the fibers in selected regions of the pile fabric comprises means for applying a continuous layer of stiffening agent and imbedding the tops of said fibers in said layer of stiffening agent, and hardening said stiffening agent.

* * * * *